US010912166B2

(12) United States Patent
Carcano et al.

(10) Patent No.: US 10,912,166 B2
(45) Date of Patent: Feb. 2, 2021

(54) RF CHOKE AND INTERFACE STRUCTURES FOR EMPLOYMENT WITH AN RF OVEN

(71) Applicant: ILLINOIS TOOL WORKS INC., Glenview, IL (US)

(72) Inventors: Marco Carcano, Senago (IT); Michele Sclocchi, San Donato Milanese (IT); Michele Gentile, Jesi (IT)

(73) Assignee: ILLINOIS TOOL WORKS, INC., Glenview, IL (US)

( * ) Notice: Subject to any disclaimer, the term of this patent is extended or adjusted under 35 U.S.C. 154(b) by 476 days.

(21) Appl. No.: 15/803,882

(22) Filed: Nov. 6, 2017

(65) Prior Publication Data

US 2018/0153002 A1 May 31, 2018

Related U.S. Application Data

(60) Provisional application No. 62/428,120, filed on Nov. 30, 2016.

(51) Int. Cl.
*H05B 6/76* (2006.01)

(52) U.S. Cl.
CPC ..... *H05B 6/763* (2013.01)

(58) Field of Classification Search
None
See application file for complete search history.

(56) References Cited

U.S. PATENT DOCUMENTS 3,629,537 A * 12/1971 Haagensen ..... H05B 6/763 219/741
4,137,441 A * 1/1979 Bucksbaum ..... H05B 6/763 219/742

(Continued)

FOREIGN PATENT DOCUMENTS

| | | | |
|---|---|---|---|
| DE | 3409563 | A1 | 9/1985 |
| GB | 1368105 | A | 9/1974 |
| WO | 2012007842 | A2 | 1/2012 |

OTHER PUBLICATIONS

International Search Report and Written Opinion of PCT/US2017/060266 dated Mar. 5, 2018.

*Primary Examiner* — Ibrahime A Abraham
*Assistant Examiner* — Elizabeth M Sims
(74) *Attorney, Agent, or Firm* — Burr & Forman, LLP

(57) ABSTRACT

An RF choke for an oven having a door movable between an open position and a closed position to interface with an opening defined in a cooking chamber of the oven includes a base portion and a plurality of resonant elements formed in rows. The cooking chamber is defined at least in part by a top wall, a bottom wall, a first sidewall and a second sidewall. The RF choke is disposed at a portion of the door facing the cooking chamber when the door is in the closed position. The base portion is a metallic sheet and is disposed in a first plane substantially parallel to a second plane in which the door lies. The resonant elements are folded out of the first plane toward the door to define a top row of resonant elements, a bottom row of resonant elements, a first side row of resonant elements and a second side row of resonant elements, which are proximate to respective ones of the top wall, the bottom wall, the first sidewall and the second sidewall of the cooking chamber when the door is in the closed position. At least one of the rows is folded out of the first plane at a different angle relative to the first plane than other ones of the rows.

18 Claims, 6 Drawing Sheets

(56) References Cited

U.S. PATENT DOCUMENTS

| | | | | |
|---|---|---|---|---|
| 4,742,201 | A * | 5/1988 | Nakano | H05B 6/763 219/742 |
| 5,958,278 | A * | 9/1999 | Engebritson | H05B 6/763 219/741 |
| 2011/0290230 | A1 | 12/2011 | Sim et al. | |
| 2013/0228568 | A1* | 9/2013 | Huynh | H05B 6/763 219/774 |
| 2014/0159832 | A1* | 6/2014 | Einziger | H03H 1/0007 333/185 |

* cited by examiner

RF CHOKE AND INTERFACE STRUCTURES FOR EMPLOYMENT WITH AN RF OVEN

CROSS REFERENCE TO RELATED APPLICATIONS

This application claims priority to U.S. application No. 62/428,120 filed Nov. 30, 2016, the entire contents of which are incorporated by reference in its entirety.

TECHNICAL FIELD

Example embodiments generally relate to ovens and, more particularly, relate to an oven that uses radio frequency (RF) heating along with convection heating and an RF choke for use with the same.

BACKGROUND

Combination ovens that are capable of cooking using more than one heating source (e.g., convection, steam, microwave, etc.) have been in use for decades. Each cooking source comes with its own distinct set of characteristics. Thus, a combination oven can typically leverage the advantages of each different cooking source to attempt to provide a cooking process that is improved in terms of time and/or quality.

In some cases, microwave cooking may be faster than convection or other types of cooking. Thus, microwave cooking may be employed to speed up the cooking process. However, a microwave typically cannot be used to cook some foods and also cannot brown foods. Given that browning may add certain desirable characteristics in relation to taste and appearance, it may be necessary to employ another cooking method in addition to microwave cooking in order to achieve browning. In some cases, the application of heat for purposes of browning may involve the use of heated airflow provided within the oven cavity to deliver heat to a surface of the food product.

However, even by employing a combination of microwave and airflow, the limitations of conventional microwave cooking relative to penetration of the food product may still render the combination less than ideal. Moreover, a typical microwave is somewhat indiscriminate or uncontrollable in the way it applies energy to the food product. Thus, it may be desirable to provide further improvements to the ability of an operator to achieve a superior cooking result. However, providing an oven with improved capabilities relative to cooking food with a combination of controllable RF energy and convection energy may require the structures and operations of the oven to be substantially redesigned or reconsidered.

BRIEF SUMMARY OF SOME EXAMPLES

Some example embodiments may therefore provide improved structures and/or systems for applying heat to the food product in the oven. Moreover, such improvements may necessitate new arrangements for supporting or operating such structures or systems.

In an example embodiment, an oven is provided. The oven may include a door movable between an open position and a closed position, a cooking chamber configured to receive a food product, an RF energy source configured to apply RF energy to the food product, and an RF choke disposed at a portion of the door facing the cooking chamber when the door is in the closed position. The cooking chamber may be defined at least in part by a top wall, a bottom wall, a first sidewall and a second sidewall, the cooking chamber further defining an opening that interfaces with the door. The RF choke may include a base portion made from a metallic sheet, and a plurality of resonant elements. The base portion may be disposed in a first plane substantially parallel to a second plane in which the door lies. The resonant elements may be folded out of the first plane toward the door. The resonant elements may be formed in rows to define a top row of resonant elements, a bottom row of resonant elements, a first side row of resonant elements and a second side row of resonant elements, which are proximate to respective ones of the top wall, the bottom wall, the first sidewall and the second sidewall of the cooking chamber when the door is in the closed position. At least one of the rows may be folded out of the first plane at a different angle relative to the first plane than other ones of the rows.

In an example embodiment, an RF choke for an oven having a door movable between an open position and a closed position to interface with an opening defined in a cooking chamber of the oven is provided. The RF choke may include a base portion and a plurality of resonant elements formed in rows. The cooking chamber may be defined at least in part by a top wall, a bottom wall, a first sidewall and a second sidewall. The RF choke may be disposed at a portion of the door facing the cooking chamber when the door is in the closed position. The base portion may be a metallic sheet having peripheral edges. The base portion may be disposed in a first plane substantially parallel to a second plane in which the door lies. The resonant elements may be folded out of the first plane toward the door to define a top row of resonant elements, a bottom row of resonant elements, a first side row of resonant elements and a second side row of resonant elements, which are proximate to respective ones of the top wall, the bottom wall, the first sidewall and the second sidewall of the cooking chamber when the door is in the closed position. At least one of the rows may be folded out of the first plane at a different angle relative to the first plane than other ones of the rows.

Some example embodiments may improve the cooking performance or operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
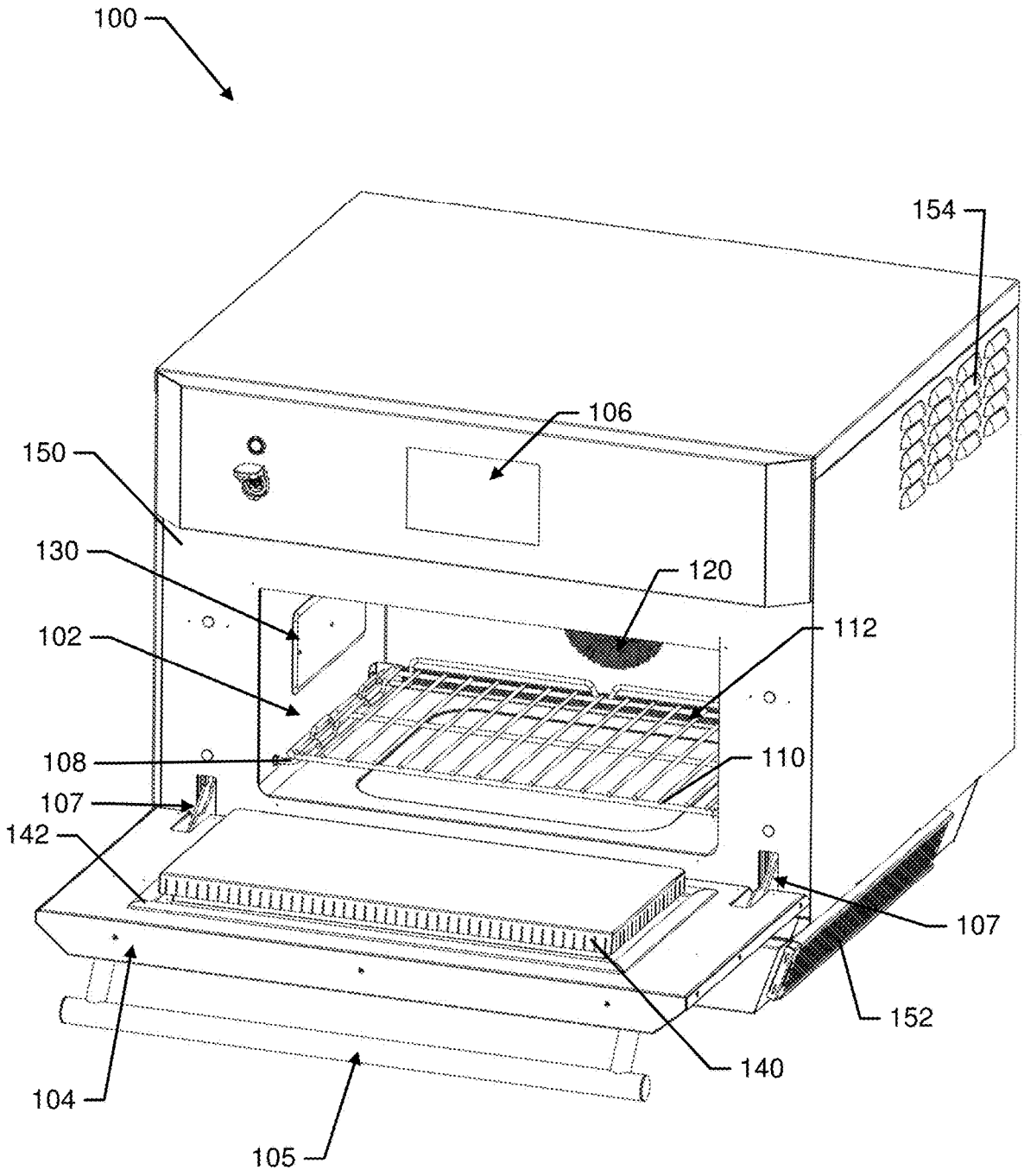
FIG. 1 illustrates a perspective view of an oven capable of employing at least two energy sources according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments may improve the cooking performance of an oven and/or may improve the operator experience of individuals employing an example embodiment. In this regard, the oven may cook food relatively quickly, based on the application of controllable RF energy, and also enable the food to be browned by providing hot air into the oven with a convection system as described herein. However, in order to increase cooking speed using RF energy, prevention of RF leakage becomes an important consideration. Meanwhile, the cleanability of the oven also remains a key component to providing a quality product. Accordingly, some example embodiments may provide an improved choke design and interface structure to achieve the goals of maintaining RF energy within the cooking chamber of the oven, while also allowing the interface between the door and the cooking chamber to be improved.

FIG. 1 illustrates a perspective view of an oven 1 according to an example embodiment. As shown in FIG. 1, the oven 100 may include a cooking chamber 102 into which a food product may be placed for the application of heat by any of at least two energy sources that may be employed by the oven 100. The cooking chamber 102 may include a door 104 and an interface panel 106, which may sit proximate to the door 104 when the door 104 is closed. The door 104 may be operable via handle 105, which may extend across the front of the oven 100 parallel to the surface upon which the oven is supported. In some cases, the interface panel 106 may be located substantially above the door 104 (as shown in FIG. 1) or alongside the door 104 in alternative embodiments. In an example embodiment, the interface panel 106 may include a touch screen display capable of providing visual indications to an operator and further capable of receiving touch inputs from the operator. The interface panel 106 may be the mechanism by which instructions are provided to the operator, and the mechanism by which feedback is provided to the operator regarding cooking process status, options and/or the like. The door 104 may rotate between an open position (shown in FIG. 1) and a closed position via a hinge assembly 107.

In some embodiments, the oven 100 may include multiple racks or may include rack (or pan) supports 108 or guide slots in order to facilitate the insertion of one or more racks 110 or pans holding food product that is to be cooked. In an example embodiment, air delivery orifices 112 may be positioned proximate to the rack supports 108 (e.g., just below a level of the rack supports in one embodiment) to enable heated air to be forced into the cooking chamber 102 via a heated-air circulation fan (not shown in FIG. 1). The heated-air circulation fan may draw air in from the cooking chamber 102 via a chamber outlet port 120 disposed at a rear wall (i.e., a wall opposite the door 104) of the cooking chamber 102. Air may be circulated from the chamber outlet port 120 back into the cooking chamber 102 via the air delivery orifices 112. After removal from the cooking chamber 102 via the chamber outlet port 120, air may be cleaned, heated, and pushed through the system by other components prior to return of the clean, hot and speed controlled air back into the cooking chamber 102. This air circulation system, which includes the chamber outlet port 120, the air delivery orifices 112, the heated-air circulation fan, cleaning components, and all ducting therebetween, may form a first air circulation system within the oven 100.

In an example embodiment, food product placed on a pan or one of the racks 110 (or simply on a base of the cooking chamber 102 in embodiments where racks 110 are not employed) may be heated at least partially using radio frequency (RF) energy. Meanwhile, the airflow that may be provided may be heated to enable further heating or even browning to be accomplished. Of note, a metallic pan may be placed on one of the rack supports 108 or racks 110 of some example embodiments. However, the oven 100 may be configured to employ frequencies and/or mitigation strategies for detecting and/or preventing any arcing that might otherwise be generated by using RF energy with metallic components.

In an example embodiment, the RF energy may be delivered to the cooking chamber 102 via an antenna assembly 130 disposed proximate to the cooking chamber 102. In some embodiments, multiple components may be provided in the antenna assembly 130, and the components may be placed on opposing sides of the cooking chamber 102. The antenna assembly 130 may include one or more instances of a power amplifier, a launcher, waveguide and/or the like that are configured to couple RF energy into the cooking chamber 102.

The cooking chamber 102 may be configured to provide RF shielding on five sides thereof (e.g., the top, bottom, back, and right and left sides), but the door 104 may include a choke 140 to provide RF shielding for the front side. The choke 140 may therefore be configured to fit closely with the opening defined at the front side of the cooking chamber 102 to prevent leakage of RF energy out of the cooking chamber 102 when the door 104 is shut and RF energy is being applied into the cooking chamber 102 via the antenna assembly 130.

In an example embodiment, a gasket 142 may be provided to extend around the periphery of the choke 140. In this regard, the gasket 142 may be formed from a material such as wire mesh, rubber, silicon, or other such materials that may be somewhat compressible between the door 104 and a periphery of the opening into the cooking chamber 102. The gasket 142 may, in some cases, provide a substantially air tight seal. However, in other cases (e.g., where the wire mesh is employed), the gasket 142 may allow air to pass therethrough. Particularly in cases where the gasket 142 is substantially air tight, it may be desirable to provide an air cleaning system in connection with the first air circulation system described above.

The antenna assembly 130 may be configured to generate controllable RF emissions into the cooking chamber 102 using solid state components. Thus, the oven 100 may not employ any magnetrons, but instead use only solid state components for the generation and control of the RF energy applied into the cooking chamber 102. The use of solid state components may provide distinct advantages in terms of allowing the characteristics (e.g., power/energy level, phase and frequency) of the RF energy to be controlled to a greater degree than is possible using magnetrons. However, since relatively high powers are necessary to cook food, the solid state components themselves will also generate relatively high amounts of heat, which must be removed efficiently in order to keep the solid state components cool and avoid damage thereto. To cool the solid state components, the oven 100 may include a second air circulation system.

The second air circulation system may operate within an oven body 150 of the oven 100 to circulate cooling air for preventing overheating of the solid state components that power and control the application of RF energy to the cooking chamber 102. The second air circulation system may include an inlet array 152 that is formed at a bottom (or basement) portion of the oven body 150. In particular, the basement region of the oven body 150 may be a substantially hollow cavity within the oven body 150 that is disposed below the cooking chamber 102. The inlet array 152 may include multiple inlet ports that are disposed on each opposing side of the oven body 150 (e.g., right and left sides when viewing the oven 100 from the front) proximate to the basement, and also on the front of the oven body 150 proximate to the basement. Portions of the inlet array 152 that are disposed on the sides of the oven body 150 may be formed at an angle relative to the majority portion of the oven body 150 on each respective side. In this regard, the portions of the inlet array 152 that are disposed on the sides of the oven body 150 may be tapered toward each other at an angle of about twenty degrees (e.g., between ten degrees and thirty degrees). This tapering may ensure that even when the oven 100 is inserted into a space that is sized precisely wide enough to accommodate the oven body 150 (e.g., due to walls or other equipment being adjacent to the sides of the oven body 150), a space is formed proximate to the basement to permit entry of air into the inlet array 152. At the front portion of the oven body 150 proximate to the basement, the corresponding portion of the inlet array 152 may lie in the same plane as (or at least in a parallel plane to) the front of the oven 100 when the door 104 is closed. No such tapering is required to provide a passage for air entry into the inlet array 152 in the front portion of the oven body 150 since this region must remain clear to permit opening of the door 104.

From the basement, ducting may provide a path for air that enters the basement through the inlet array 152 to move upward (under influence from a cool-air circulating fan) through the oven body 150 to an attic portion inside which control electronics (e.g., the solid state components) are located. The attic portion may include various structures for ensuring that the air passing from the basement to the attic and ultimately out of the oven body 150 via outlet louvers 154 is passed proximate to the control electronics to remove heat from the control electronics. Hot air (i.e., air that has removed heat from the control electronics) is then expelled from the outlet louvers 154. In some embodiments, outlet louvers 154 may be provided at right and left sides of the oven body 150 and at the rear of the oven body 150 proximate to the attic. Placement of the inlet array 152 at the basement and the outlet louvers 154 at the attic ensures that the normal tendency of hotter air to rise will prevent recirculation of expelled air (from the outlet louvers 154) back through the system by being drawn into the inlet array 152. As such, air drawn into the inlet array 152 can reliably be expected to be air at ambient room temperature, and not recycled, expelled cooling air.

Figure 2:
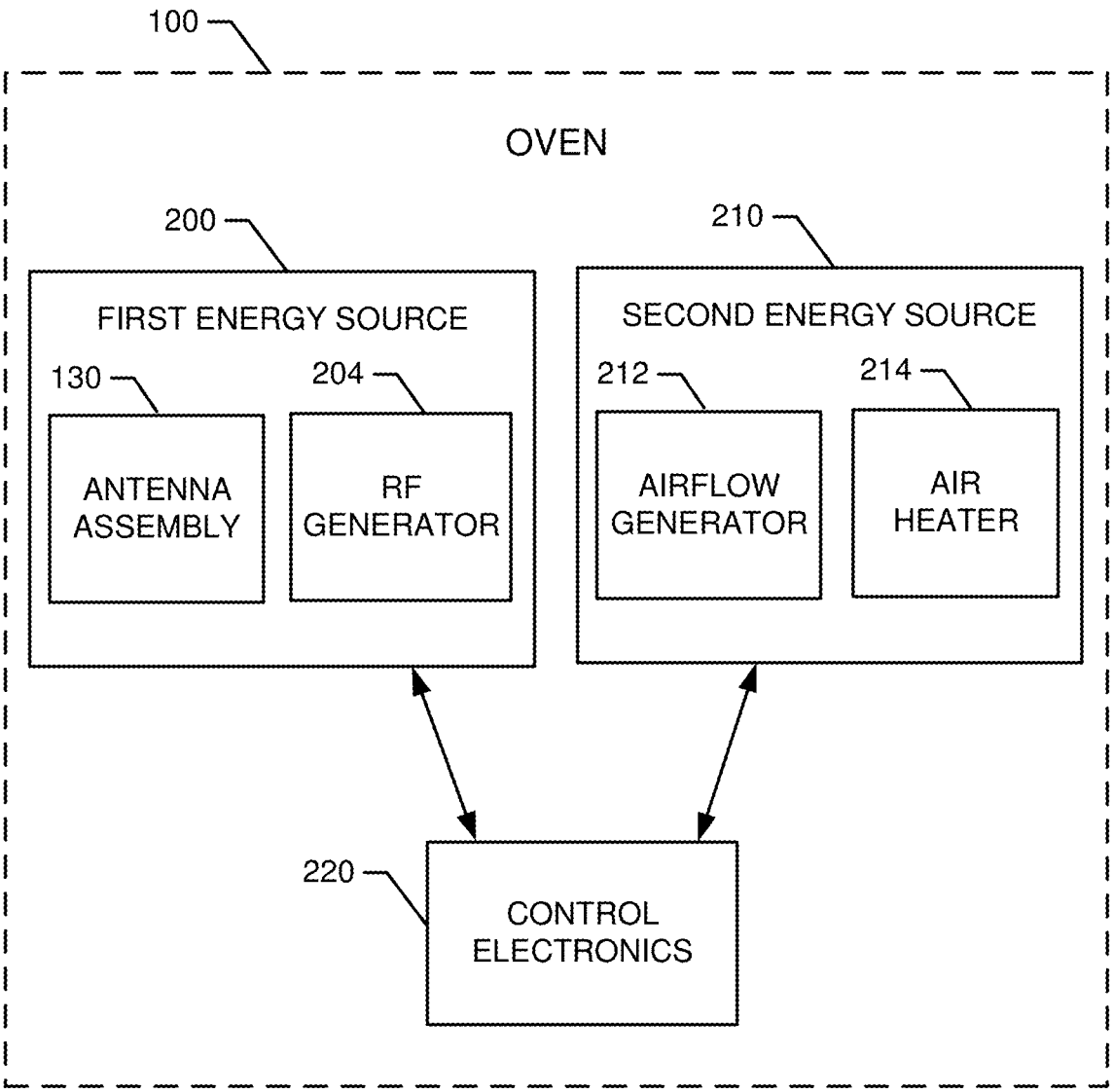
FIG. 2 illustrates a functional block diagram of the oven of FIG. 1 according to an example embodiment.

FIG. 2 illustrates a functional block diagram of the oven 100 according to an example embodiment. As shown in FIG. 2, the oven 100 may include at least a first energy source 200 and a second energy source 210. The first and second energy sources 200 and 210 may each correspond to respective different cooking methods. In some embodiments, the first and second energy sources 200 and 210 may be an RF heating source and a convective heating source, respectively. However, it should be appreciated that additional or alternative energy sources may also be provided in some embodiments. Moreover, some example embodiments could be practiced in the context of an oven that includes only a single energy source (e.g., the second energy source 210). As such, example embodiments could be practiced on otherwise conventional ovens that apply heat using, for example, gas or electric power for heating.

As mentioned above, the first energy source 200 may be an RF energy source (or RF heating source) configured to generate relatively broad spectrum RF energy or a specific narrow band, phase controlled energy source to cook food product placed in the cooking chamber 102 of the oven 100. Thus, for example, the first energy source 200 may include the antenna assembly 130 and an RF generator 204. The RF generator 204 of one example embodiment may be configured to generate RF energy at selected levels and with selected frequencies and phases. In some cases, the frequencies may be selected over a range of about 6 MHz to 246 GHz. However, other RF energy bands may be employed in some cases. In some examples, frequencies may be selected from the ISM bands for application by the RF generator 204.

In some cases, the antenna assembly 130 may be configured to transmit the RF energy into the cooking chamber 102 and receive feedback to indicate absorption levels of respective different frequencies in the food product. The absorption levels may then be used to control the generation of RF energy to provide balanced cooking of the food product. Feedback indicative of absorption levels is not necessarily employed in all embodiments however. For example, some embodiments may employ algorithms for selecting frequency and phase based on pre-determined strategies identified for particular combinations of selected cook times, power levels, food types, recipes and/or the like. In some embodiments, the antenna assembly 130 may include multiple antennas, waveguides, launchers, and RF transparent coverings that provide an interface between the antenna assembly 130 and the cooking chamber 102. Thus, for example, four waveguides may be provided and, in some cases, each waveguide may receive RF energy generated by its own respective power module or power amplifier of the RF generator 204 operating under the control of control electronics 220. In an alternative embodiment, a single multiplexed generator may be employed to deliver different energy into each waveguide or to pairs of waveguides to provide energy into the cooking chamber 102.

In an example embodiment, the second energy source 210 may be an energy source capable of inducing browning and/or convective heating of the food product. Thus, for example, the second energy source 210 may a convection heating system including an airflow generator 212 and an air heater 214. The airflow generator 212 may be embodied as or include the heated-air circulation fan or another device capable of driving airflow through the cooking chamber 102 (e.g., via the air delivery orifices 112). The air heater 214 may be an electrical heating element or other type of heater that heats air to be driven toward the food product by the airflow generator 212. Both the temperature of the air and the speed of airflow will impact cooking times that are achieved using the second energy source 210, and more particularly using the combination of the first and second energy sources 200 and 210.

In an example embodiment, the first and second energy sources 200 and 210 may be controlled, either directly or indirectly, by the control electronics 220. The control electronics 220 may be configured to receive inputs descriptive of the selected recipe, food product and/or cooking conditions in order to provide instructions or controls to the first and second energy sources 200 and 210 to control the cooking process. In some embodiments, the control electronics 220 may be configured to receive static and/or dynamic inputs regarding the food product and/or cooking conditions. Dynamic inputs may include feedback data regarding phase and frequency of the RF energy applied to the cooking chamber 102. In some cases, dynamic inputs may include adjustments made by the operator during the cooking process. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), a selection of a recipe (e.g., defining a series of cooking steps) and/or the like.

In some embodiments, the control electronics 220 may be configured to also provide instructions or controls to the airflow generator 212 and/or the air heater 214 to control airflow through the cooking chamber 102. However, rather than simply relying upon the control of the airflow generator 212 to impact characteristics of airflow in the cooking chamber 102, some example embodiments may further employ the first energy source 200 to also apply energy for cooking the food product so that a balance or management of the amount of energy applied by each of the sources is managed by the control electronics 220.

In an example embodiment, the control electronics 220 may be configured to access algorithms and/or data tables that define RF cooking parameters used to drive the RF generator 204 to generate RF energy at corresponding levels, phases and/or frequencies for corresponding times determined by the algorithms or data tables based on initial condition information descriptive of the food product and/or based on recipes defining sequences of cooking steps. As such, the control electronics 220 may be configured to employ RF cooking as a primary energy source for cooking the food product, while the convective heat application is a secondary energy source for browning and faster cooking. However, other energy sources (e.g., tertiary or other energy sources) may also be employed in the cooking process.

In some cases, cooking signatures, programs or recipes may be provided to define the cooking parameters to be employed for each of multiple potential cooking stages or steps that may be defined for the food product and the control electronics 220 may be configured to access and/or execute the cooking signatures, programs or recipes (all of which may generally be referred to herein as recipes). In some embodiments, the control electronics 220 may be configured to determine which recipe to execute based on inputs provided by the user except to the extent that dynamic inputs (i.e., changes to cooking parameters while a program is already being executed) are provided. In an example embodiment, an input to the control electronics 220 may also include browning instructions. In this regard, for example, the browning instructions may include instructions regarding the air speed, air temperature and/or time of application of a set air speed and temperature combination (e.g., start and stop times for certain speed and heating combinations). The browning instructions may be provided via a user interface accessible to the operator, or may be part of the cooking signatures, programs or recipes.

As discussed above, the first energy source 200 may be an RF energy source configured to generate selected RF frequencies (e.g., in the ISM band) into the cooking chamber 102. The choke 140 may be provided to seal the RF frequencies in the cooking chamber 102 during operation of the oven 100 with the door 104 closed. The choke 140 therefore operates at the interface between the cooking chamber 102 and the door 104. The interface is the relatively large opening into the front of the cooking chamber 102.

The choke 140 is provided to seal RF energy at the interface by providing what is essentially a tuned reflector assembly to keep RF energy in the cooking chamber 102. The choke 140 is constructed based on providing a quarter-wave resonant circuit. More particularly, the choke 140 employs ¼ wavelength (λ) resonant elements that have a width that is substantially uniform around the perimeter of the choke 140. The provision of these types of ¼ wavelength resonant elements is, as a general matter, relatively conventional. However, because of the nature of the shape of the cooking chamber 102, and the size and weight of the door 105, example embodiments may employ a uniquely structured design for the choke 140. Moreover, because the choke 140 has a uniquely structured design, the method of making the choke 140 may also be unique.

Figure 3A:
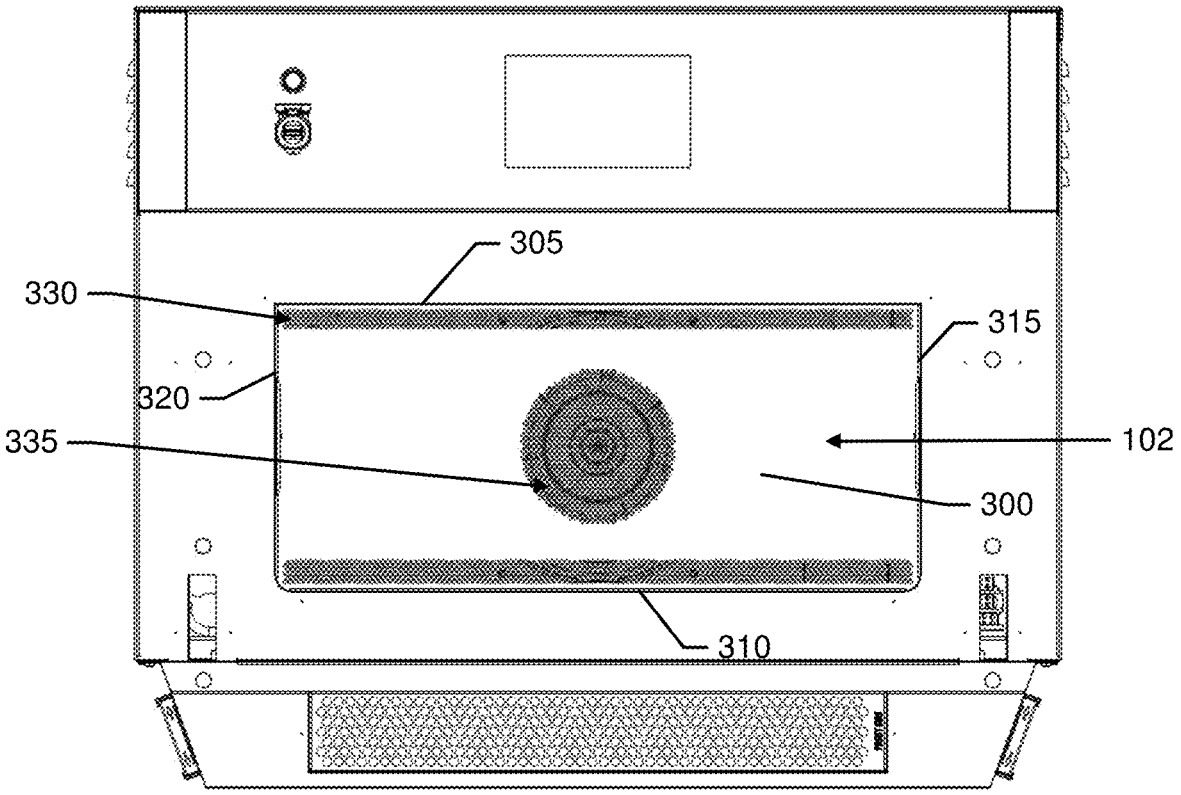
FIG. 3A illustrates a front view of a cooking chamber of the oven with the door removed according to an example embodiment.
Figure 3B:
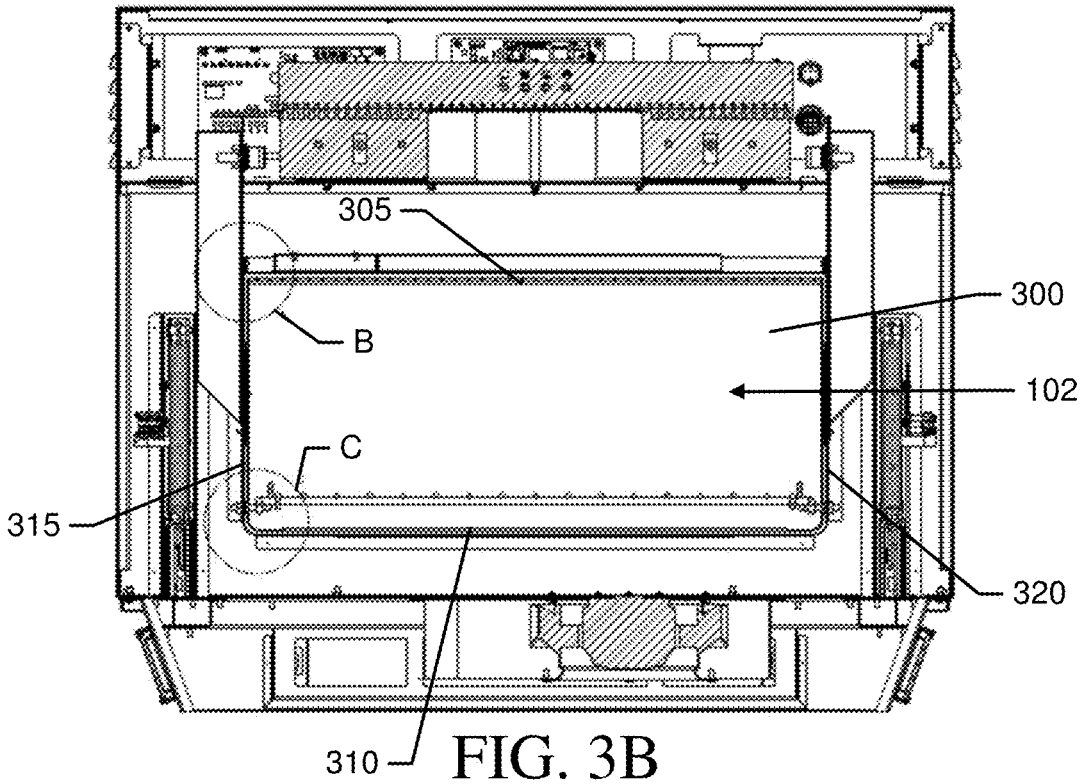
FIG. 3B illustrates a cross section view of the cooking chamber looking forward from a rear perspective according to an example embodiment.
Figure 3C:
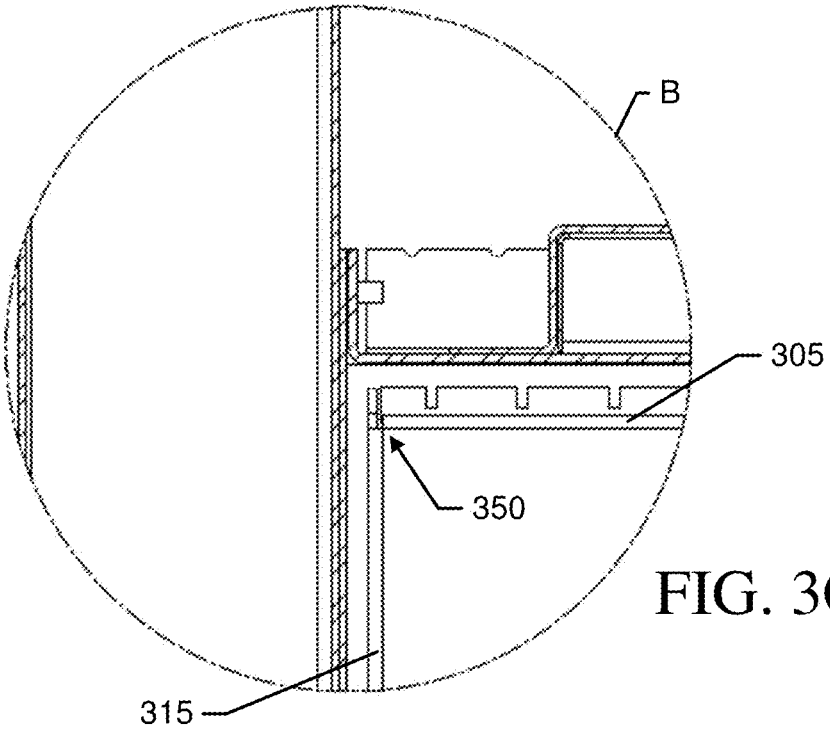
FIG. 3C illustrates a closer view of a top corner portion of the cooking chamber according to an example embodiment.
Figure 3D:
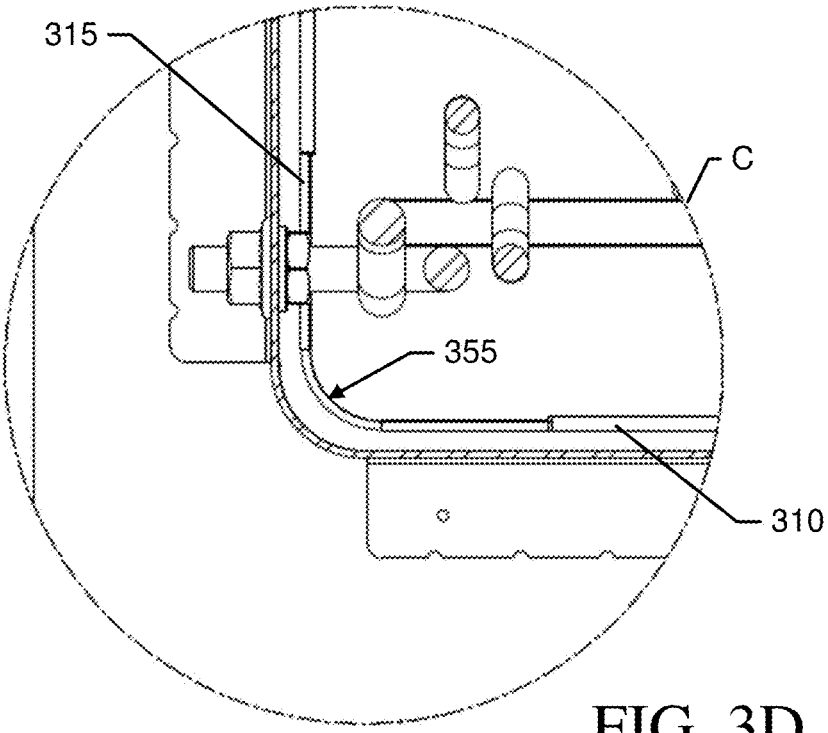
FIG. 3D illustrates a closer view of a bottom corner portion of the cooking chamber according to an example embodiment.

Before the specific structure of the choke 140 is described, the general shape of the cooking chamber 102 and unique aspects of the interface will be discussed to give a greater appreciation for the potential desire for inclusion of the unique structural design aspects mentioned above in reference to FIG. 3, which is defined by FIGS. 3A, 3B, 3C and 3D. In this regard, FIG. 3A illustrates a front view of the cooking chamber 102 with the door 104 removed, and FIG. 3B illustrates a cross section view of the cooking chamber 102 looking forward from a rear perspective. FIG. 3C illustrates a closer view of a top corner portion of the cooking chamber 102, which portion is labeled as circle B in FIG. 3B. FIG. 3D illustrates a closer view of a bottom corner portion of the cooking chamber 102, which portion is labeled as circle C in FIG. 3B.

Referring primarily to FIGS. 3A, 3B, 3C and 3D, the cooking chamber 102 is defined by five fixed walls and the door 104 (shown in FIG. 1, but not in FIG. 3). The five fixed walls include a back wall 300, a top wall 305, a bottom wall, 310, a first sidewall 315 and second sidewall 320. The first and second sidewalls 315 and 320 are opposing sidewalls and could be considered right and left sidewalls, respectively, when the cooking chamber 102 is viewed through the opening formed when the door 104 is opened. The back wall 300 includes inlet air perforations 330 and outlet air perforations 335 through which air passes (and RF energy cannot pass) as part of the first air circulation system. The back wall 300, the top wall 305, the bottom wall, 310, and the first and second sidewalls 315 and 320 are each substantially planar in shape (e.g., forming a substantially rectangular planar surface) and the planar surfaces of each wall terminate at linearly arranged ends that are joined to adjacent walls at respective intersections As shown in FIG. 3, the intersection between the top wall 305 and the first sidewall 315 forms a substantially 90 degree intersection. In other words, not only does the top wall 305 extend substantially perpendicular to the first sidewall 315, but the intersection between the top wall 305 and the first sidewall 315 also substantially forms a right angle along its entire length. Similarly, the intersection between the top wall 305 and the second sidewall 320 forms a substantially 90 degree intersection. In other words, not only does the top wall 305 extend substantially perpendicular to the second sidewall 320, but the intersection between the top wall 305 and the second sidewall 320 also substantially forms a right angle along its entire length. The intersection between the top wall 305 and the back wall 300 is also similar.

However, the intersections between the bottom wall 310 and both the first and second sidewalls 315 and 320 (and corresponding corners formed thereby) are different. In this regard, although the bottom wall 310 extends substantially perpendicular to the first sidewall 315, the intersection between the bottom wall 310 and the first sidewall 315 does not form a right angle along its entire length. Instead, the intersection between the bottom wall 310 and the first sidewall 315 is curved along its entire length. Similarly, although the bottom wall 310 extends substantially perpendicular to the second sidewall 320, the intersection between the bottom wall 310 and the second sidewall 320 does not form a right angle along its entire length. Instead, the intersection between the bottom wall 310 and the second sidewall 320 is also curved along its entire length. The curves of the respective interfaces between the bottom wall 310 and both the first and second sidewalls 315 and 320 are substantially symmetrical about a centerline dividing the cooking chamber 102 midway between the respective corners. The intersections between the back wall 300 and each of the first and second sidewalls 315 and 320 and the bottom wall 310 are substantially right angle intersections except at the region where the first and second sidewalls 315 and 320 meet the bottom wall 310.

Referring specifically to FIGS. 3C and 3D, the intersection between the first sidewall 315 and the top wall 305 may form a right angle corner 350. As discussed above, the second sidewall 320 may also meet the top wall 305 at a similarly structured interface to the right angle corner 350 of FIG. 3C. Meanwhile, the intersection between the first sidewall 315 and the bottom wall 310 may form a curved corner 355. The curved corner 355 may provide a surface that is substantially easier to clean than would a right angle corner in this position (i.e., at the bottom of the cooking chamber 102). In this regard, for example, spills or splatter created by the cooking process or after insertion of food product into the cooking chamber 102 can leave materials that would be very difficult (and sometimes impossible) to clean if the curved corner 355 were instead a right angle corner. Furthermore, after a spill or splatter is exposed to high heat, the material may become difficult to remove, further exacerbating the problem described above, and causing a buildup of material over time. By providing the curved corner 355, the surface associated therewith can more easily be cleaned either by the application of cleaning agents, the application of cleaning force, and/or by the use of tools that would otherwise be difficult to apply to a right angle corner. Meanwhile, for corners near the top of the cooking chamber 102, it is far less likely that splatter or spills will reach these surfaces, so a right angle corner (and the simplicity of designing and building the cooking chamber 102). In particular, in an example embodiment, the bottom wall 310 and both the first and second sidewalls 315 and 320 may be made from a single sheet of material (e.g., metal). Thus, the single sheet may be bent to form an instance of the curved corner 355 between the bottom wall 310 and each of the first and second sidewalls 315 and 320. Then, the top wall 310 and the back wall 300, each of which may be individual planar sheets of metal, can be affixed to the single sheet of material forming the bottom wall 310 and both the first and second sidewalls 315 and 320. Moreover, in some cases, the back wall 300 and top wall 305 could be a single sheet bent at a right angle at their intersection. Thus, in some cases, the cooking chamber 102 could be formed from as little as two sheets of material or as many as three sheets of material.

Given that the cooking chamber 102 has a specific shape at the interface with the door 104 (e.g., two rounded bottom corners and two right angle top corners), the choke 140 must also have a corresponding shape. Moreover, the requirement for the door 104 to rotate between open and closed positions while putting the choke 140 in position to function properly in light of the specific shape of the interface places further design limitations on the choke 140 and may influence the most efficient and/or advantageous ways to manufacture the choke 140.

Figure 4B:
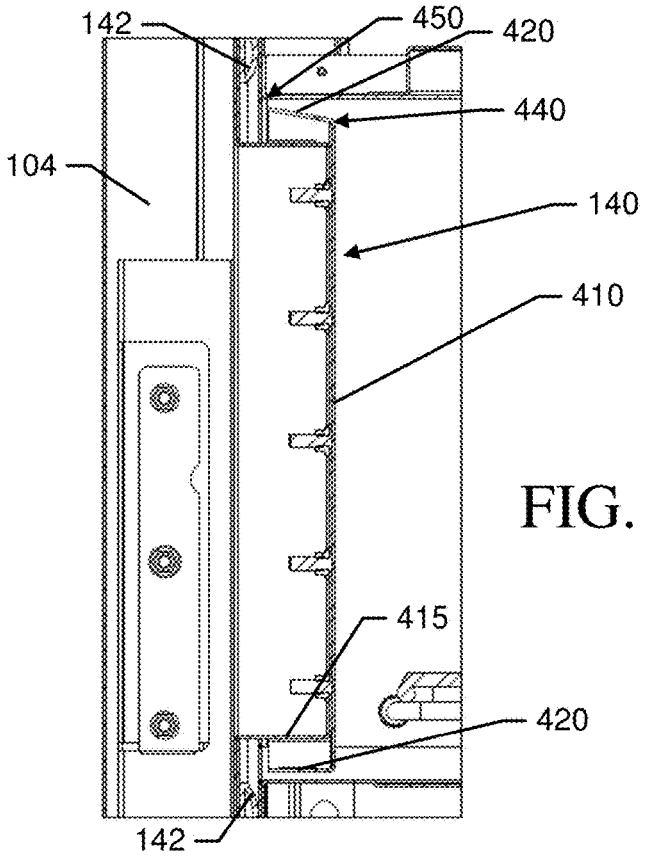
FIG. 4B illustrates a cross sectional side view taken from the same side of the oven to show the door and interface with the RF choke in the closed position according to an example embodiment.
Figure 4A:
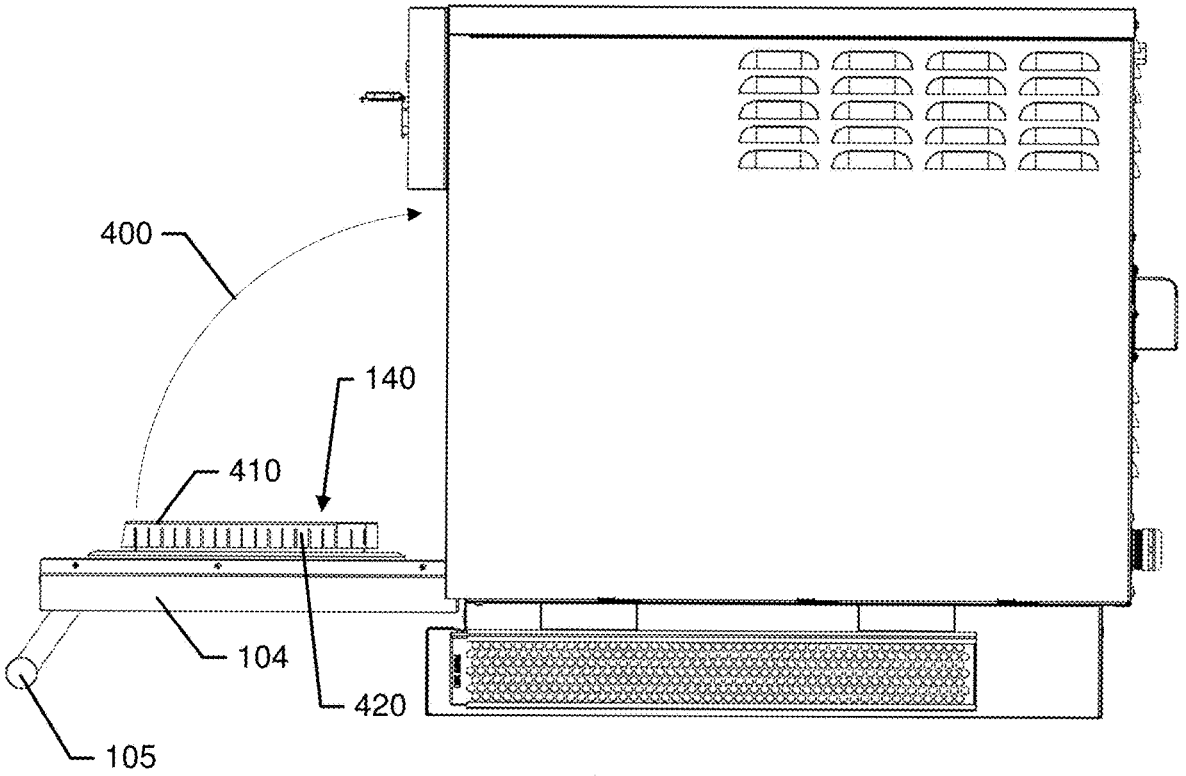
FIG. 4A illustrates a side view of the door in the open position and the RF choke provided on the door according to an example embodiment.

FIG. 4A illustrates a side view of the door 104 in the open position, and FIG. 4B illustrates a cross sectional side view taken from the same side of the oven 100 to show the door 104 in the closed position. As can be appreciated from FIG. 4A, when the handle 105 is lifted, the door 104 may rotate in the direction shown by arrow 400. As the door 104 rotates into contact with the interface with the cooking chamber 102 opening, the choke 140 will need to be inserted into the opening.

Referring to FIGS. 4A and 4B, it can be seen that the choke 140 generally includes a base portion 410 and a plurality of resonant elements 420 that extend way from the base portion 410, and are disposed around the periphery of the base portion 410. The base portion 410 is shaped substantially similarly to the shape of the opening in the cooking chamber 102, and is mounted onto an inside portion of the door 104 with a mounting structure 415. The mounting structure 415 extends in an inward direction when the door 104 is in the closed position or in an upward direction when the door 104 is in the open position. The base portion 410 may be formed of sheet metal having a thickness sufficient to give the base portion 410 a strength and durability. In this regard, pans or containers may routinely be set on (or fall on) the base portion 410 when the door 104 is in the open position. Thus, the thickness of the base portion 410 should be sufficient to handle impact and avoid any puncture damage or excessive denting or damage to the base portion 410.

As can be seen from FIG. 4B, the base portion 410 may be inserted fully into the cooking chamber 102 when the door 104 is in the closed position. Meanwhile, the resonant elements 420 extend back toward the door 104 and terminate at a point substantially in (or near) a plane with the opening of the cooking chamber 102. In other words, a plane connecting forward ends of the top wall 305, bottom wall 310 and the first and second sidewalls 315 and 320 may interest the distal ends of the resonant elements 420. The resonant elements 420 may extend around all peripheral edges of the base portion 410 back toward the door 410 such that the base portion 410 ends up being inserted into the cooking chamber 100 by a distance substantially equal to the length of the resonant elements 420.

As may be appreciated from FIG. 4B, rotation of the door 104 from the open position of FIG. 4A in the direction of arrow 400 (also shown in FIG. 4A) could cause a top portion 440 of the choke 140 to strike or impact the top edge 450 of the cooking chamber 102. Accordingly, in order to ensure that the top portion 440 of the choke 140 does not contact the top edge 450 of the cooking chamber 102 during closing of the door 104, the resonant elements 420 along the top of the choke 140 (the term "top" referring to a position when the door 104 is closed) are tapered downward as they progress inwardly (again in reference to when the door 104 is closed). In other words, the base portion 410 is substantially equidistant from the first and second sidewalls 315 and 320 and the bottom wall 310. However, the base portion 410 is spaced apart farther from the top wall 305 than from the first and second sidewalls 315 and 320 and the bottom wall 310. Moreover, the resonant elements 420 are substantially perpendicular to the base portion 410 at portions of the choke 140 that are proximate to the first and second sidewalls 315 and 320 and the bottom wall 310. Thus, the resonant elements 420 are substantially parallel to the respective ones of the first and second sidewalls 315 and 320 and the bottom wall 310. However, the resonant elements 420 form an angle relative to top wall 305 and are not either perpendicular to the base portion 410 or parallel to the top wall 305. Moreover, due to the shape of the interface at the opening of the cooking chamber 102, the choke 140 will be required to have two rounded corners and two substantially right angle corners. Thus, the relationships described above may be slightly different in areas where the rounded corners exist.

Figure 5A:
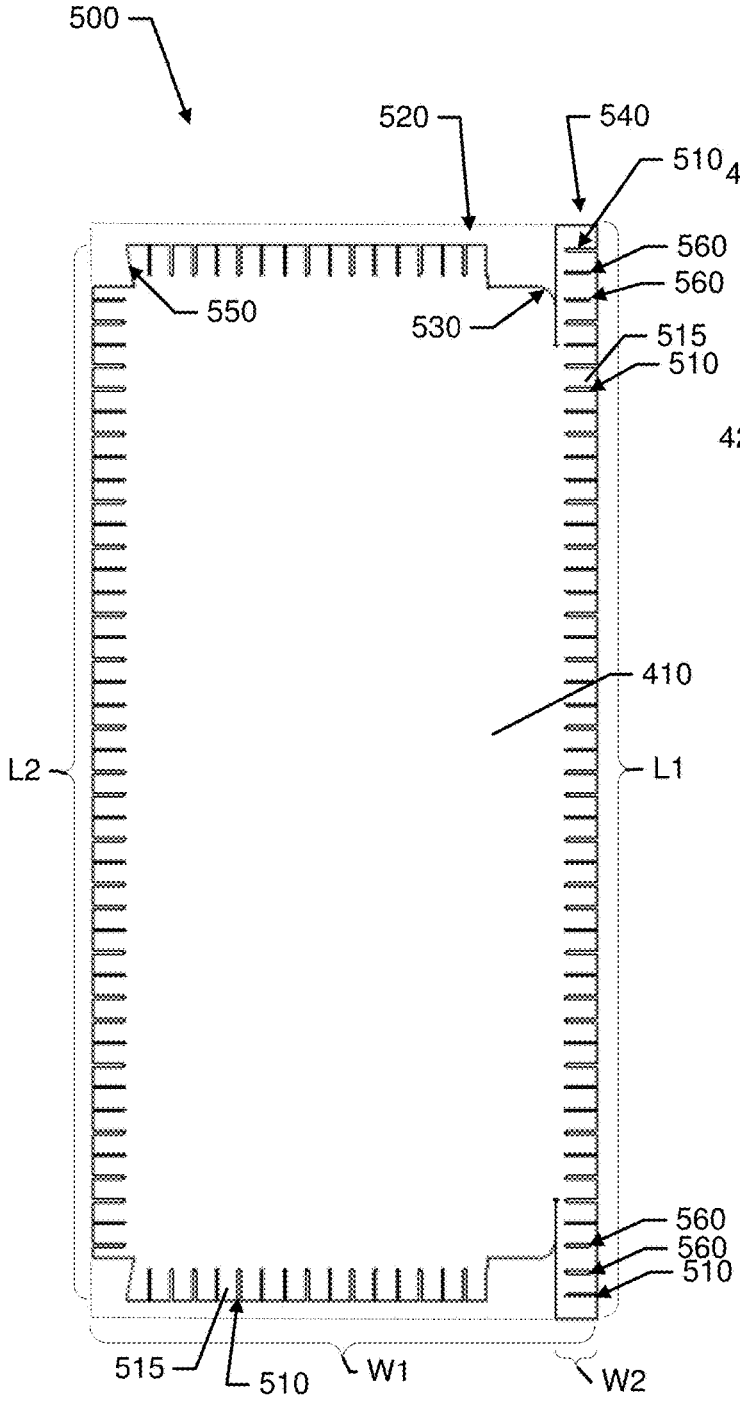
FIG. 5A illustrates a top view of a sheet that can be cut into a pre-folded choke assembly in accordance with an example embodiment.
Figure 5B:
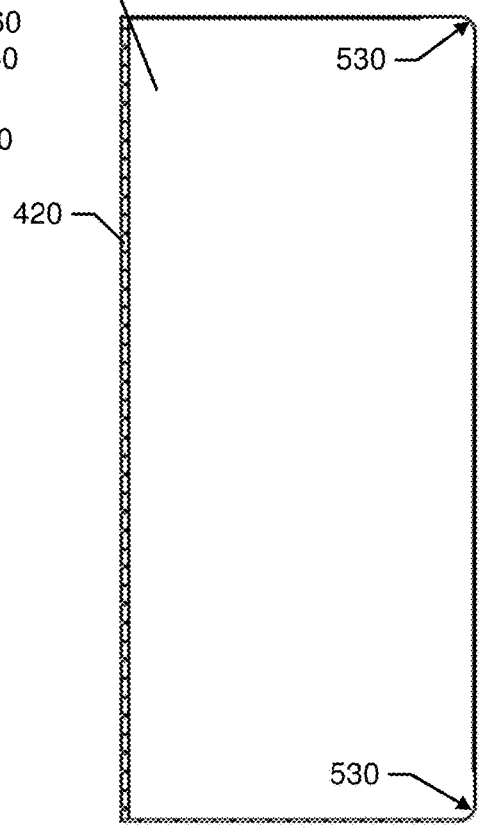
FIG. 5B illustrates a top view of the choke after cutting and folding according to an example embodiment.

The fabrication of the choke 140 may therefore also require care to achieve the necessary shape changes associated with making both the rounded corners, and one set of tapered resonant elements. FIG. 5A illustrates a top view of a sheet that can be cut into a pre-folded choke assembly in accordance with an example embodiment. FIG. 5B illustrates a top view of the choke 140 after cutting and folding.

As shown in FIG. 5A, a metallic sheet 500 may be provided to have a length L1 and a width W1. The metallic sheet 500 may be cut include a plurality of notches 510 along the periphery of the metallic sheet 500 on opposite sides that extend along the length L1. The notches 510 may generally be cut to ultimately define the resonant elements 420 to have the same width, and to have length characteristics necessary to form a quarter-wave resonant circuit at the frequencies of operation of the oven 100. The cutting of the notches 510 creates the resonant elements 420 as relatively thin tabs or projections (e.g., fingers) that extend away from the base portion 410. The resonant elements 420 therefore form a resonant short circuit with low impedance to ground so that the choke 140 forms an effective reflector to keep RF leakage signals within the cooking chamber 102. The notches 510 may have slightly different widths in some areas to create groups of one, two or three pre-folded resonant elements 515 that are closer to their adjacent resonant elements, while others are slightly more distant therefrom. Alternatively, all notches 510 may be the same size. The notches 510 may be cut directly in the periphery of the metallic sheet 500 on the longer sides thereof. However, in some cases, the notches 510 may not be cut on the shorter sides (e.g., the sides having the width W1) until a removal section 520 has been cut away from the metallic sheet 500 (via one or multiple cuts). The removal section 520 may need to be removed in order to allow round corners 530 and the tapered resonant elements 535 to be formed. In this regard, the round corners 530 may be formed to correspond to the curved corners 355 of the cooking chamber 102, and the tapered resonant elements 535 may be formed as the top portion 440 of the choke 140 to lie proximate to the top wall 305 of the cooking chamber 102.

The removal section 520 may be removed (at least in part) by cutting away a portion of opposing ends of the metallic sheet 500 to shorten the length of all portions of the metallic sheet 500 to a second length L2, except for tail pieces 540. The tail pieces 540 may each be on the same side of the metallic sheet 500 and maintain the length of the metallic piece 500 as the length L1 at the corresponding long edge of the metallic sheet 500. The tail pieces 540 may have a second width W2 that is determined by the length of the resonant elements 420 extending away from the base portion 410 (after folding). The removal section 520 may include at least some pre-folded resonant elements 515 proximate to the tail pieces 540 that are removed. The removal section 520 may further be defined by a curve cut to form the round corners 530 proximate to the tail pieces 540. A side of the removal section 520 opposite the tail pieces 540 may be cut to remove some portions of pre-folded resonant elements 515 to define a taper guide 550. The taper guide 550 defines an angled edge to which the row of tapered resonant elements 535 may be folded to define the taper angle of the tapered resonant elements 535.

As can be appreciated from FIG. 5A, after the removal section 520 is cut away, and all notches 510 are cut, the pre-folded resonant elements 515 can be folded (e.g., along a line that is disposed inwardly from the distal ends of the pre-folded resonant elements 515 by a length defined by the second width W2. The row of pre-folded resonant elements 515 that include the tail pieces 540 may be folded about 90 degrees away from the base portion 410 to define a bottom row of resonant elements 420 that will lie proximate to the bottom wall 310 when the door 104 is closed. The rows of pre-folded resonant elements 515 that are formed from the new edge that remains after the removal section 520 is cut away may be folded about 90 degrees away from the base portion 410 to define side rows or resonant elements 420 that will lie proximate to the first and second sidewalls 315 and 320 of the cooking chamber 102 when the door 104 is closed. When the side rows and bottom row have generally been formed, the tail pieces 540 may be folded along the round corners 530 and joined (e.g., via welding) to the base portion 410 and the edges of the side rows. Finally, when the pre-folded resonant elements 515 are folded so that respective end portions (as measured along the second length L2) lie proximate to the taper guide 550. A joint may be formed (e.g., via welding) along the taper guide 550 to form the row of tapered resonant elements 535.

In some cases, in order to preserve the strength of the tail pieces 540 after folding, at least one (and in this example, two) of the resonant elements on the tail piece 540 may be formed without fully cutting a notch completely to the end of the resonant element. Instead, as shown in FIG. 5A, slots 560 extending linearly away from the base portion 410 (but not entirely to the distal end of the resonant elements) may be cut in the tail piece 540 (e.g., proximate to an apex of the round corner 530). Thus, unlike resonant elements disposed at locations other than the tail piece 540 (each of which may be formed via cutting the notches 510 linearly away from the base portion 410 all the way to the distal ends of the resonant elements), the slots 560 allow more physical strength to be experienced along the bended portion without substantially sacrificing performance. The slots 560 also may prevent flaring of the resonant elements during bending around the round corners 530 to ensure consistent spacing relative to the curved corners 355. If flaring were otherwise to occur, contact or scraping could occur which could damage the choke 140 and/or damage the curved corners 355.

In an example embodiment, an RF choke for an oven having a door movable between an open position and a closed position to interface with an opening defined in a cooking chamber of the oven is provided. The RF choke may include a base portion and a plurality of resonant elements formed in rows. The cooking chamber may be defined at least in part by a top wall, a bottom wall, a first sidewall and a second sidewall. The RF choke may be disposed at a portion of the door facing the cooking chamber when the door is in the closed position. The base portion may be a metallic sheet having peripheral edges. The base portion may be disposed in a first plane substantially parallel to a second plane in which the door lies. The resonant elements may be folded out of the first plane toward the door to define a top row of resonant elements, a bottom row of resonant elements, a first side row of resonant elements and a second side row of resonant elements, which are proximate to respective ones of the top wall, the bottom wall, the first sidewall and the second sidewall of the cooking chamber when the door is in the closed position. At least one of the rows may be folded out of the first plane at a different angle relative to the first plane than other ones of the rows.

In some embodiments, additional optional features may be included or the features described above may be modified or augmented. Each of the additional features, modification or augmentations may be practiced in combination with the features above and/or in combination with each other. Thus, some, all or none of the additional features, modification or augmentations may be utilized in some embodiments. For example, in some cases, the base portion may have a shape substantially matching a shape of the opening. In such an example, a distance between the base portion and the top wall of the cooking chamber may be larger than a distance between the base portion and each of the bottom wall and the first and second sidewalls of the cooking chamber. In an example embodiment, the top row of resonant elements may be folded out of the first plane at the different angle relative to the first plane than the bottom row of resonant elements, the first side row of resonant elements and the second side row of resonant elements. In some examples, distal ends of resonant elements in each of the top row of resonant elements, the bottom row of resonant elements, the first side row of resonant elements and the second side row of resonant elements may be substantially equidistant from respective ones of the top wall, the bottom wall, the first sidewall and the second sidewall of the cooking chamber when the door is in the closed position. In an example embodiment, an intersection between the top wall and both of the first and second sidewalls forms a right angle, and an intersection between the bottom wall and both of the first and second sidewalls forms a curved corner. In some cases, the base portion may define a substantially round corner to correspond to the curved corner at intersections between the bottom row of resonant elements and the first and second side rows of resonant elements. In an example embodiment, the base portion may define a substantially right angle corner to correspond to the right angle at intersections between the top wall and the first and second sidewalls. In some examples, a tail piece of the bottom row of resonant elements may be folded around the substantially round corner to correspond to the curved corner. In such examples, at least one resonant element on the tail piece may be formed via slots extending linearly away from the base portion, and resonant elements disposed at locations other than the tail piece may be formed via notches cut linearly away from the base portion. In an example embodiment, distal ends of resonant elements of each of the each of the top row of resonant elements, the bottom row of resonant elements, the first side row of resonant elements and the second side row of resonant elements lie in a plane of the opening.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

a door movable between an open position and a closed position;

a cooking chamber configured to receive a food product, the cooking chamber being defined at least in part by a top wall, a bottom wall, a first sidewall and a second sidewall, the cooking chamber further defining an opening that interfaces with the door;

a radio frequency (RF) energy source configured to apply RF energy to the food product; and an RF choke disposed at a portion of the door facing the cooking chamber when the door is in the closed position, wherein the RF choke comprises:

a base portion comprising a metallic sheet, the base portion being disposed in a first plane parallel to a second plane in which the door lies; and a plurality of resonant elements folded out of the first plane toward the door, the resonant elements being formed in rows to define a top row of resonant elements, a bottom row of resonant elements, a first side row of resonant elements and a second side row of resonant elements, which are proximate to respective ones of the top wall, the bottom wall, the first sidewall and the second sidewall of the cooking chamber when the door is in the closed position, wherein at least one of the rows is folded out of the first plane at a different angle relative to the first plane than other ones of the rows, wherein the base portion has a shape matching a shape of the opening and includes a top edge, a bottom edge and side edges, wherein the top edge is proximate to the top wall of the cooking chamber, the bottom edge is proximate to the bottom wall of the cooking chamber, and the side edges are proximate to the first and second sidewalls of the cooking chamber when the door is in the closed position, and wherein, when the door is in the closed position, a distance between the top edge of the base portion and the top wall of the cooking chamber is larger than a distance between the bottom edge and side edges of the base portion and each of the bottom wall and the first and second sidewalls of the cooking chamber, respectively.

2. The oven of claim 1, wherein the top row of resonant elements is folded out of the first plane at the different angle relative to the first plane than the bottom row of resonant elements, the first side row of resonant elements and the second side row of resonant elements.

3. The oven of claim 1, wherein distal ends of resonant elements in each of the top row of resonant elements, the bottom row of resonant elements, the first side row of resonant elements and the second side row of resonant elements are equidistant from respective ones of the top wall, the bottom wall, the first sidewall and the second sidewall of the cooking chamber when the door is in the closed position.

4. The oven of claim 1, wherein an intersection between the top wall and both of the first and second sidewalls forms a right angle, and an intersection between the bottom wall and both of the first and second sidewalls forms a curved corner.

5. The oven of claim 4, wherein the base portion defines a round corner to correspond to the curved corner at intersections between the bottom row of resonant elements and the first and second side rows of resonant elements.

6. The oven of claim 5, wherein the base portion defines a right angle corner to correspond to the right angle at intersections between the top wall and the first and second sidewalls.

7. The oven of claim 6, wherein a tail piece of the bottom row of resonant elements is folded around the round corner to correspond to the curved corner.

8. The oven of claim 7, wherein at least one resonant element on the tail piece is formed via slots extending linearly away from the base portion, and resonant elements disposed at locations other than the tail piece are formed via slots cut linearly away from the base portion.

9. The oven of claim 1, wherein distal ends of resonant elements of each of the top row of resonant elements, the bottom row of resonant elements, the first side row of resonant elements and the second side row of resonant elements lie in a plane of the opening.

10. A radio frequency (RF) choke for an oven, the oven having a door movable between an open position and a closed position to interface with an opening defined in a cooking chamber of the oven, the cooking chamber being defined at least in part by a top wall, a bottom wall, a first sidewall and a second sidewall, the RF choke being disposed at a portion of the door facing the cooking chamber when the door is in the closed position, the RF choke comprising:

a base portion comprising a metallic sheet, the base portion being disposed in a first plane parallel to a second plane in which the door lies; and a plurality of resonant elements folded out of the first plane toward the door, the resonant elements being formed in rows to define a top row of resonant elements, a bottom row of resonant elements, a first side row of resonant elements and a second side row of resonant elements, which are proximate to respective ones of the top wall, the bottom wall, the first sidewall and the second sidewall of the cooking chamber when the door is in the closed position, wherein at least one of the rows is folded out of the first plane at a different angle relative to the first plane than other ones of the rows, wherein the base portion has a shape matching a shape of the opening and includes a top edge, a bottom edge and side edges, wherein the top edge is proximate to the top wall of the cooking chamber, the bottom edge is proximate to the bottom wall of the cooking chamber, and the side edges are proximate to the first and second sidewalls of the cooking chamber when the door is in the closed position, and wherein, when the door is in the closed position, a distance between the top edge of the base portion and the top wall of the cooking chamber is larger than a distance between the bottom edge and side edges of the base portion and each of the bottom wall and the first and second sidewalls of the cooking chamber, respectively.

11. The RF choke of claim 10, wherein the top row of resonant elements is folded out of the first plane at the different angle relative to the first plane than the bottom row of resonant elements, the first side row of resonant elements and the second side row of resonant elements.

12. The RF choke of claim 10, wherein distal ends of resonant elements in each of the top row of resonant elements, the bottom row of resonant elements, the first side row of resonant elements and the second side row of resonant elements are equidistant from respective ones of the top wall, the bottom wall, the first sidewall and the second sidewall of the cooking chamber when the door is in the closed position.

13. The RF choke of claim 10, wherein an intersection between the top wall and both of the first and second sidewalls forms a right angle, and an intersection between the bottom wall and both of the first and second sidewalls forms a curved corner.

14. The RF choke of claim 13, wherein the base portion defines a round corner to correspond to the curved corner at intersections between the bottom row of resonant elements and the first and second side rows of resonant elements.

15. The RF choke of claim 14, wherein the base portion defines a right angle corner to correspond to the right angle at intersections between the top wall and the first and second sidewalls.

16. The RF choke of claim 14, wherein a tail piece of the bottom row of resonant elements is folded around the round corner to correspond to the curved corner.

17. The RF choke of claim 16, wherein at least one resonant element on the tail piece is formed via slots extending linearly away from the base portion, and resonant elements disposed at locations other than the tail piece are formed via slots cut linearly away from the base portion.

18. The RF choke of claim 10, wherein distal ends of resonant elements of each of the row of resonant elements, the bottom row of resonant elements, the first side row of resonant elements and the second side row of resonant elements lie in a plane of the opening.

* * * * *